US006358120B1

(12) United States Patent
Poling et al.

(10) Patent No.: US 6,358,120 B1
(45) Date of Patent: Mar. 19, 2002

(54) VISION ENHANCED UNDER WATER WATERJET

(75) Inventors: Gary R. Poling; Orvile L. Lindsey, both of Lynchburg; Ronald J. Payne, Forest, all of VA (US)

(73) Assignee: Framatome Anp. Inc., Lynchburg, VA (US)

( * ) Notice: Subject to any disclaimer, the term of this patent is extended or adjusted under 35 U.S.C. 154(b) by 0 days.

(21) Appl. No.: 09/594,072

(22) Filed: Jun. 14, 2000

(51) Int. Cl.[7] ..... B24C 9/00
(52) U.S. Cl. ..... 451/40; 451/102
(58) Field of Search ..... 451/75, 6, 2, 92, 451/102, 38, 39, 40, 87, 88

(56) References Cited

U.S. PATENT DOCUMENTS 4,536,789 A * 8/1985 Bains ..... 358/319
5,797,290 A * 8/1998 Blissell et al. ..... 72/53
5,947,051 A * 9/1999 Geiger ..... 114/313

FOREIGN PATENT DOCUMENTS

GB 2175976 * 12/1986 ..... 451/76
NL 7703359 * 10/1978 ..... 451/75

* cited by examiner

*Primary Examiner*—Robert A. Rose
(74) *Attorney, Agent, or Firm*—Vytas R. Matas

(57) ABSTRACT

An enhanced visibility underwater waterjet cutting system is provided wherein the waterjet cutting assembly and the video camera for remotely viewing the operating system is enclosed within an enclosure spacedly set against the workpiece and a stream of clean water is injected into the enclosure to set up a flow of clean water past the camera and to the waterjet cutting tip to exhaust the cuttings away from the enclosure and camera to allow a continuous view of the cutting surface of the workpiece without clouding up the water in the enclosure.

16 Claims, 6 Drawing Sheets

VISION ENHANCED UNDER WATER WATERJET

BACKGROUND OF THE INVENTION

1. Field of the Invention

The present invention generally relates to underwater waterjet cutting systems and more particularly to such systems having improved visibility of the cutting surface.

2. Description of the Prior Art

Underwater waterjet cutting involves the use of pure high pressure waterjets containing abrasive particles being used to cut materials such as stainless steel. In applications such as decommissioned nuclear reactor vessels the cutting of the stainless steel results in cutting fines and other debris particles clouding the water in the cutting area requiring the operator to cease cutting until the cutting area clears up and again becomes visible.

Certain systems are known which attempts to clear the cutting area of cutting fines and other debris.

One such system is shown in U.S. Pat. No. 5,211,752 to Allerton. This system teaches a waterjet cutting device being sealably enclosed within an enclosure from which the cutting particles are exhausted through an end located vacuum outlet leading to some collection container to keep the enclosed surface particle clear for cutting visibility. The system envisions application other than underwater cutting and is more interested in preventing the pollution of the ambient atmosphere rather than maintaining a visible cutting path for underwater fluidjet cutting. The enclosure is sealed rather than open at the work surface cutting area and there is no teaching of how to maintain a clear water stream applied to the cutting area to keep it clear of particles and provide enhanced waterjet cutting visibility.

Another system is shown in U.S. Pat. No. 5,778,713. This system teaches the use of waterjet devices underwater for penning and not waterjet cutting. Again, there is lacking any teaching of an open rather than sealed enclosure or of providing a clean water stream at the cutting surface to provide a visible cutting path during underwater waterjet cutting.

Another system found in U.S. Pat. No. 5,353,054 teaches the use of a laser imaging and ranging device for use by divers in performing various underwater tasks such as cutting. However, there is no teaching of how this system is to be implemented or modified for underwater waterjet cutting.

It is thus seen that the prior art failed to provide any teachings of a vision enhanced underwater waterjet cutting systems which would maintain a visible cutting area free of cutting fines allowing a continuous waterjet cutting operation.

SUMMARY OF THE INVENTION

The present invention solves the problems associated with prior art cutting systems and other by providing an improved underwater waterjet cutting system using a method and apparatus for maintaining the vision path clear of cutting fines between an underwater waterjet cutting tool tip and the work surface to allow a speedy and accurate cut. To accomplish this, an underwater enclosure is positioned at the cutting surface having an opening at the contact area between the enclosure and the cutting tip surface. A stream of clean water is applied to the cutting tip and work surface area and exhausted from the enclosure openings to keep the cutting surface clear of cutting fines and other particles which make for poor visibility and slow cutting.

The openings may be provided by a small peripheral opening along the bottom of the enclosure. In some cases the front panel of the enclosure may be removed to form a three sided enclosure allowing easy access to the waterjet for ease of service and replaceability.

In view of the foregoing it will be seen that one aspect of the present disclosure is to provide an underwater waterjet cutting system having improved cutting surface visibility.

Another aspect of the present invention is to provide an underwater waterjet cutting system enclosure having a continuous flow of clean water therethrough to clear the cutting area free of cutting fines and other debris.

Yet another aspect of the present invention is to provide a waterjet cutting system enclosure exhausting cutting fines from the cutting surface through the bottom periphery of the enclosure.

Still yet another aspect of the present invention is to provide a waterjet cutting system enclosure having an open area along the waterjet cutting head to allow easy replacement and service thereof.

These and other aspects of the present invention will be more fully understood upon a review of the following description of the preferred embodiment when considered in conjunction with the accompanying drawings.

DESCRIPTION OF THE PREFERRED EMBODIMENT

Figure 1:
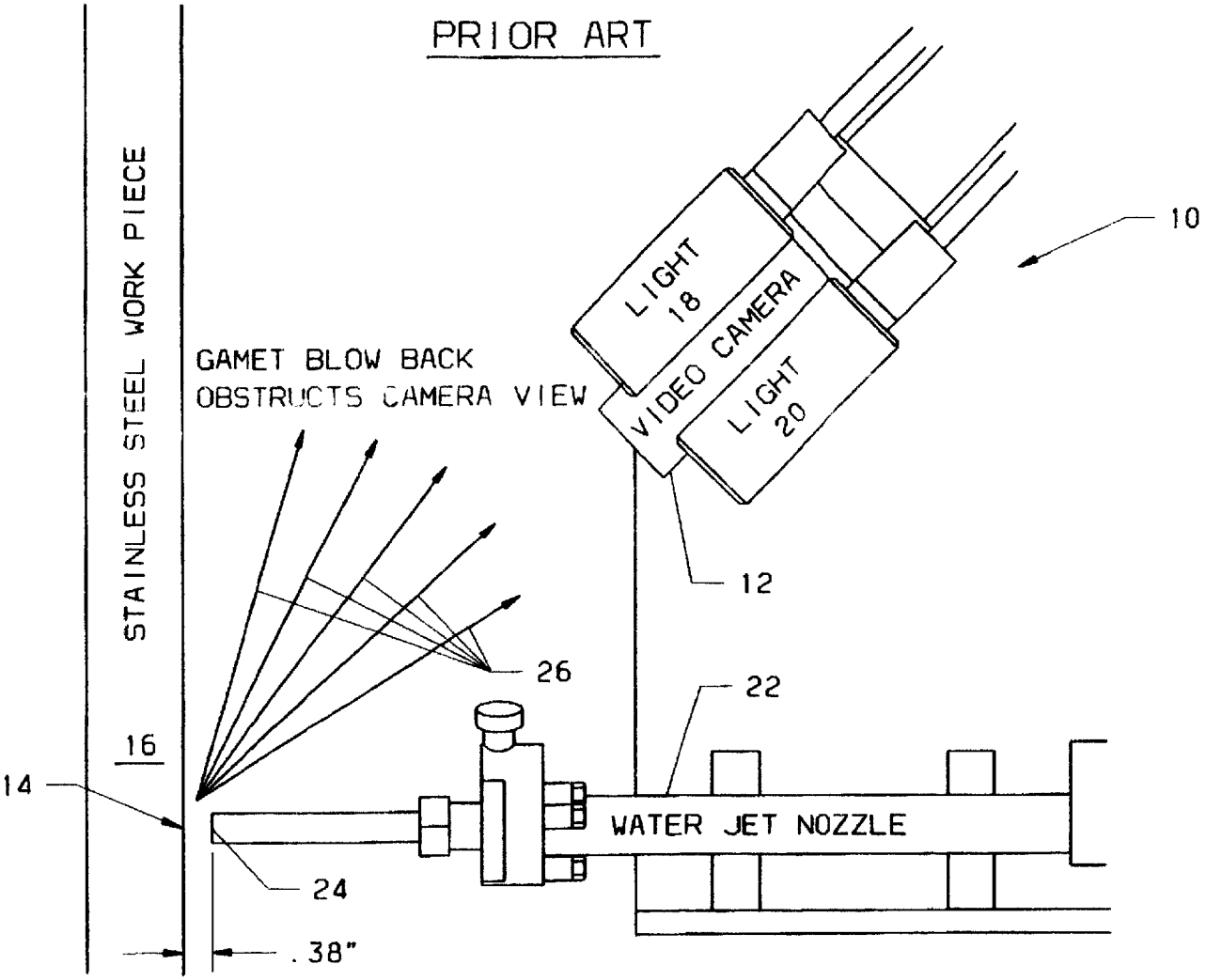
FIG. 1 is a side view schematic of a prior art underwater waterjet cutting system without any cutting head enclosure.

Referring now to the drawings where the embodiments are intended to describe a preferred embodiment of the invention and not limit it to same.

FIG. 1 shows a prior art underwater waterjet cutting system (10) without any visibility enhancing means.

Figure 2:
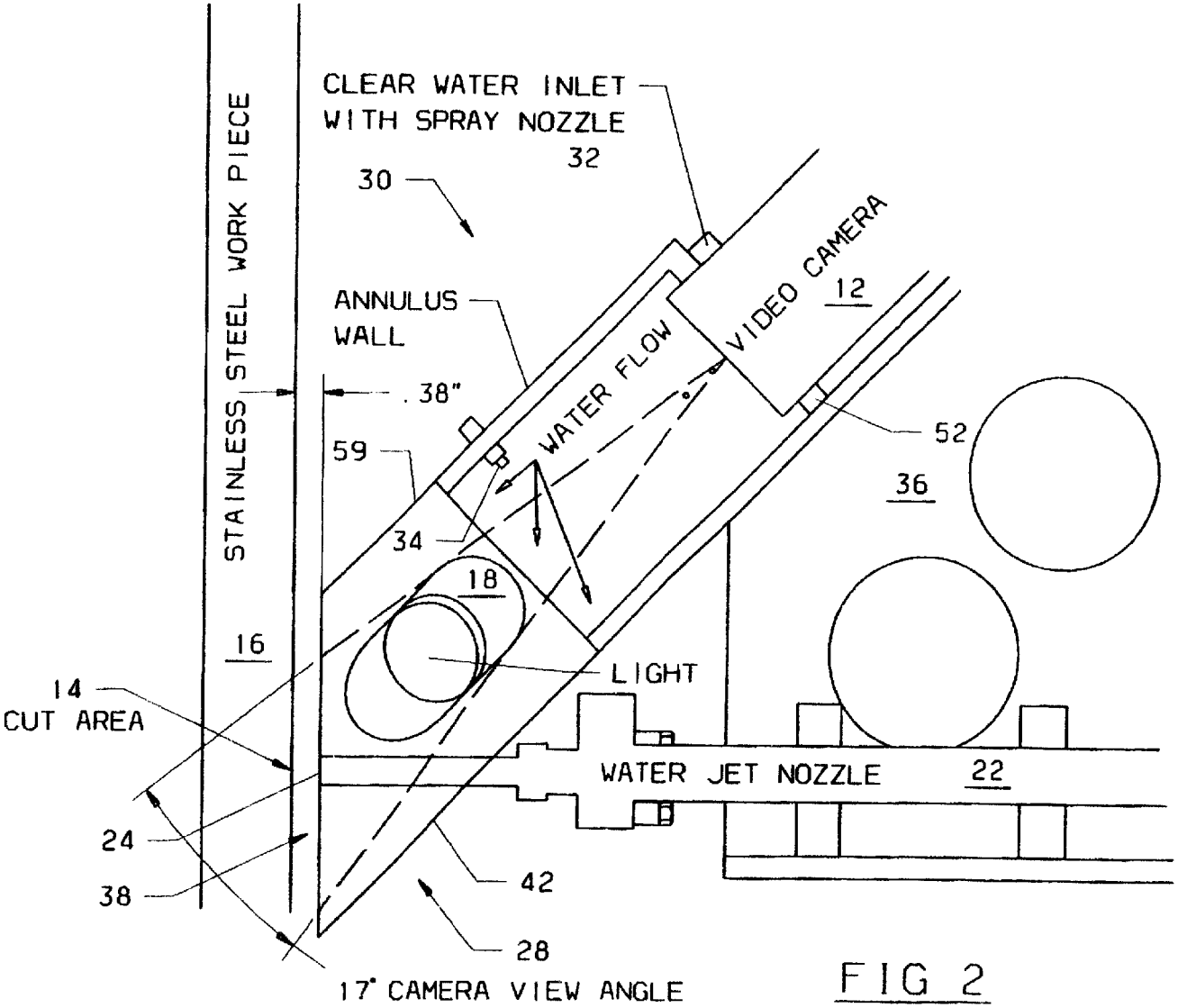
FIG. 2 is a side view of the FIG. 1 system using one type of vision enhancement enclosure of the present invention.
Figure 5:
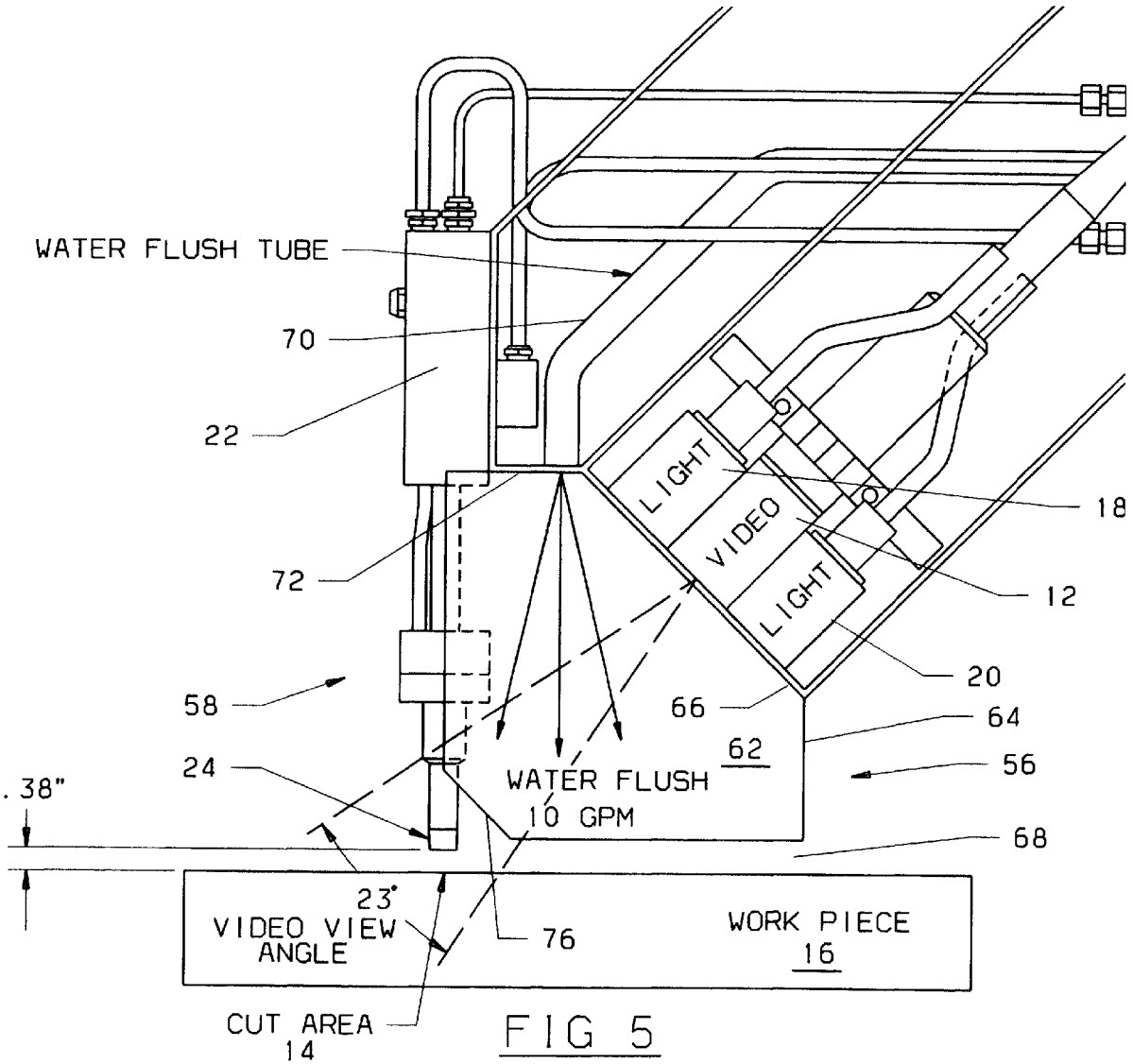
FIG. 5 is a top schematic view of a second type of waterjet cutting head enclosure of the present invention.

The system (10) is submerged in water and includes a video camera (12) aimed at the cutting area (14) of a stainless steel workpiece (16) at a 45° angle to obtain depth perceptions. A pair of 500 watt lights (18, 20) is mounted proximate to the video camera (12) to illuminate the cutting area (14) sufficiently for the camera (12) to transmit a viewable picture to a remote location (not shown) from which the waterjet cutting system (10) is operated in a known manner. The system (10) also includes a waterjet nozzle (22) the tip (24) of which is spaced 0.38 inches from the workpiece and shoots a known high pressure water/garnet mixture at the working piece cutting area (14) to cut the workpiece in a known manner. The cutting process results in cutting fines being blown back into the camera (12) as shown by the arrows (26) to cloud the water in the vicinity of the camera (12) making visibility of the cutting area (14) impossible. Thus, a method of keeping the vision path between the camera (12) and nozzle (24) clear of debris was needed. Two different designs of a concept are shown in FIGS. 2 and 5. Horizontal and vertical orientations accommodate different cutting environments. The general idea employed, involves creating an isolated channel or "annulus" along the vision path through which clear water is continuously flushed to prevent the garnet blow back from clouding the water at the cutting area and obscuring the view of the camera (12).

Figure 3:
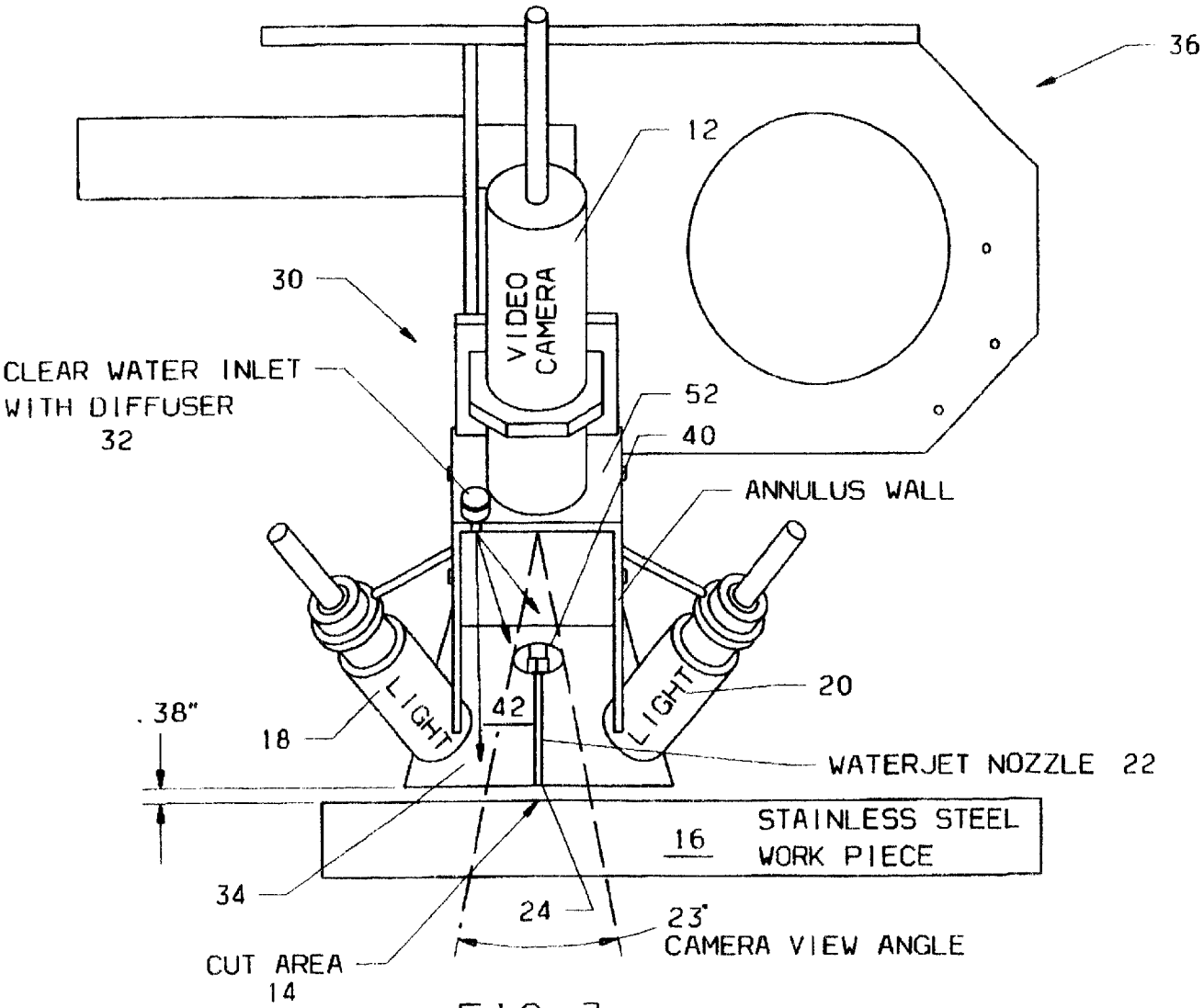
FIG. 3 is a top view of the FIG. 2 system with the enclosure wall removed.
Figure 4:
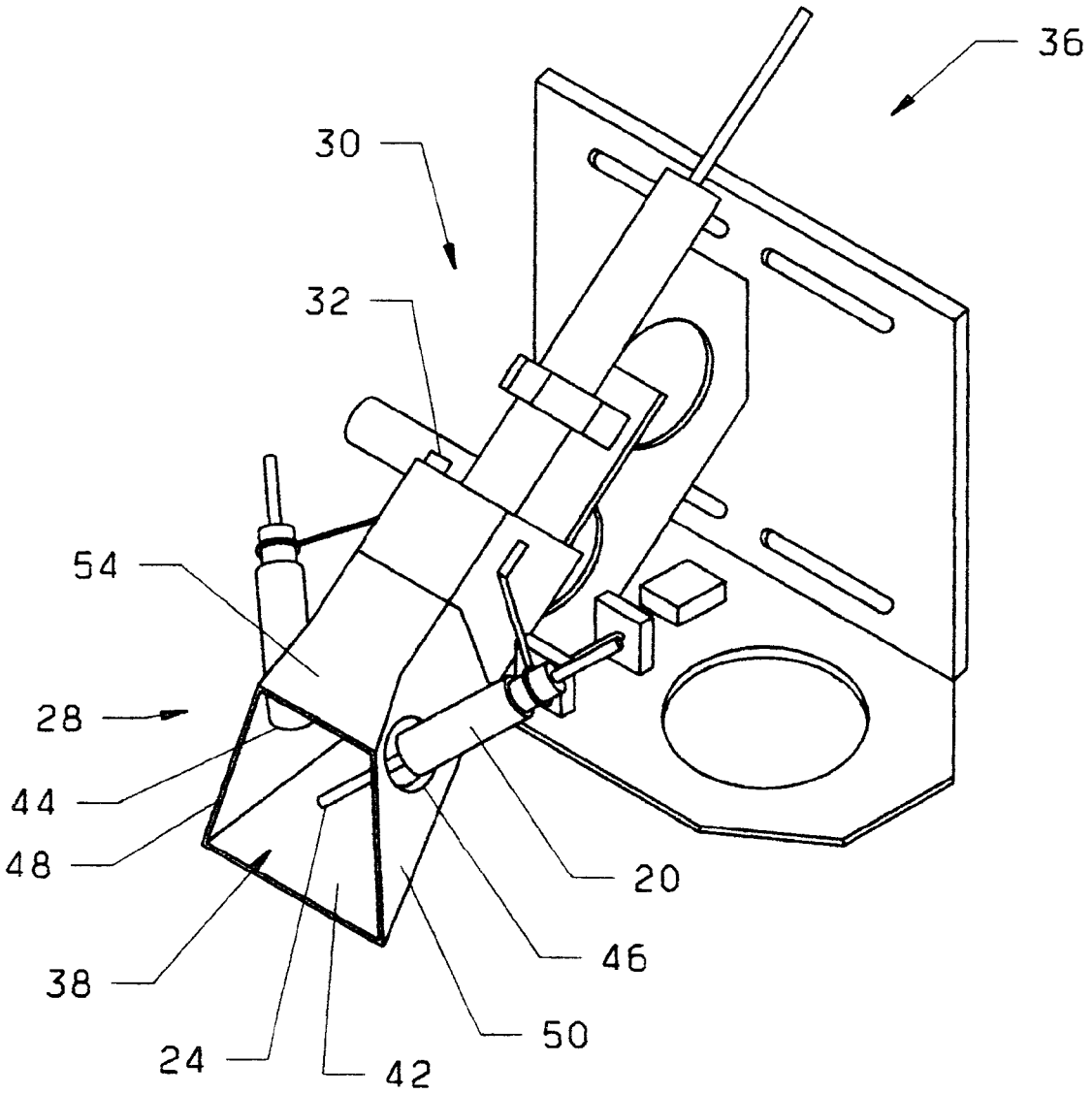
FIG. 4 is a perspective view of the FIG. 2 system.

One embodiment or design is shown in FIGS. 2–4. The basic prior art system (10) seen in FIG. 1 is completely isolated within an enclosure (28) to form a visibility enhanced underwater waterjet cutting system (30). The system (30) has a clean water connection (32) which is connected to a water line (not shown) which provides a 10 gallon/minute flow of clean water to the enclosure (28) along a path defined by the arrows (34). The system (30) is mounted to a bracket assembly (36) which in turn is movably mounted to a known fixture (not shown) which allows the open face (38) of the enclosure (28) to be aligned 0.38 inches from the workpiece (16) to provide a peripheral venting of the clean water from the connection (32) along this peripheral opening. This venting entrains the garnet and cutting fines occurring at the cutting area (14) and exhausts them along the peripheral opening keeping them from blowing back and clouding the water at the cutting area (14) thus enhancing the camera (12) visibility throughout the waterjet cutting process. The water within the enclosure (28) is thus maintained clear throughout the cutting process and there is no need to interrupt cutting to wait for the water to clear.

The system (30) has the waterjet nozzle (22) entering the enclosure through an opening (40) formed one side (42) of the enclosure (28). The opening (42) is not sealed and can allow some water to flow out of the enclosure. The 10 gallons/minute flow of clean water is sufficient to keep the garnet cutting fines swept away through the peripheral enclosure (28) openings even with the unsealed waterjet nozzle (22) entry hole (40). The lights (18, 20) are located inside the enclosure through respective openings (44, 46) formed on opposite walls (48, 50) of the enclosure (28) adjoining wall (42). These openings are also not sealed since the clean water flow is sufficient to sweep away the cutting debris. The video camera (12) is mounted through an end wall (52) of the enclosure (28) opposite the open enc (38). The camera is located above the lights (18, 20) so that the camera (12) has a view angle of 17° of the workpiece (16) walls (42) and (54) and a view angle of 23° between walls (48, 50).

Figure 6:
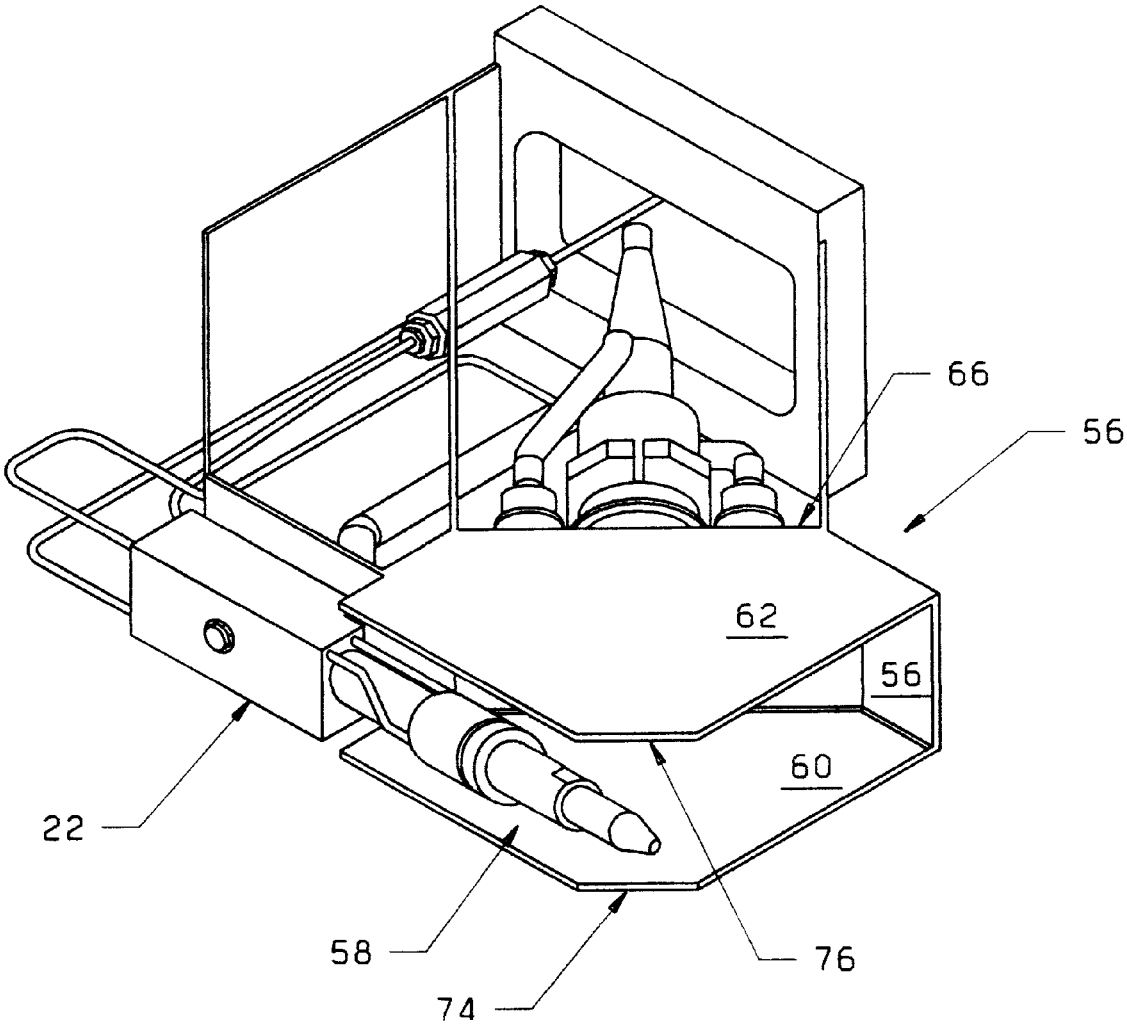
FIG. 6. is a perspective view of the FIG. 5 enclosure embodiment of the invention.

An alternate embodiment of the present invention is best seen in FIGS. 5–6. Here an enclosure (56) is constructed to have the waterjet located at an open end (58) of the enclosure (56) with the tip (24) located between opposite walls (60, 62). A back wall opposite the open end (58) if formed from a straight wall section (64) and an angled wall section (66). The lights (18, 20) and the video camera (12) are mounted in line to the angled wall section (66) which is angled at approximately 45° to provide depth perception to the video camera (12) of the workpiece (16) cutting area to allow the operator to gauge the depth of the unit. The video camera (12) is placed to have the same video view angles as described in FIGS. 2–3.

The enclosure (56) is aligned with the workpiece to have the top (24) of the waterjet (22) approximately 0.38 inches from the workpiece with the walls (60, 62, 56) providing a [peripheral gap (68) between the enclosure (56) and the workpiece (16). The open end (58) of the enclosure is partially blocked by the waterjet (22) assembly to thus produce some restriction to water flow through the open end (58).

A clean water pipe (70) is mounted to a top wall (72) of the enclosure (56) to provide a 10 gallon/minute flow to the inside of the enclosure (56) which flow exhausts from the peripheral opening (68) and along the tip (24) of the waterjet (22) to flush away the garnet cutting fines and other debris thus keeping a clean water view of the cutting area (14) by the camera (12).

The walls (60, 62) have a triangular cut surface (74, 76) to help direct the clean water from the pipe (70) to the cutting tip (24) of the waterjet (22) to keep both the tip (24) and the cutting area (14) free of cutting fines.

The open end (58) of the enclosure (56) allows easy adjustment and replacement of the waterjet (22) while using the waterjet (22) as a partial wall to insure an annular clean water flow along the periphery (68) and cutting tip (24).

It will be understood that certain obvious additions and modifications have been deleted herein for the sake of conciseness and readability but they properly fall within the scope of the following claims. As an example, a collection tube could be located along the exhaust of the annular flow from the enclosures to collect the garnet cutting fines.

What is claimed is:

1. A vision enhanced underwater waterjet workpiece cutting system comprising;

a waterjet located proximate to a workpiece for cutting the workpiece using a high pressure water stream;

a video camera for remotely viewing the cutting of the workpiece;

means for illuminating the workpiece to allow viewing of the workpiece cutting by said video camera;

an enclosure for containing said waterjet, said video camera, and said illuminating means while leaving a peripheral opening between the said enclosure, the workpiece; and means for supplying a clean water flow to said enclosure part, said video camera and to said workpiece to exhaust any cutting debris from the cutting of the workpiece through the peripheral opening of said enclosure.

2. A system as set forth in claim 1 wherein said waterjet uses an abrasive in said high pressure water.

3. A system as set forth in claim 2 where said abrasive is garnet.

4. A system as set forth in claim 1 wherein said video camera is mounted in said enclosure to have an approximately 45° angle view of the workpiece to provide depth perception.

5. A system as set forth in claim 4 wherein said clean water supplying means supplies clean water to said enclosure at the rate of approximately 10 gallons/minute.

6. A system as set forth in claim 5 wherein the peripheral opening of said enclosure is approximately 0.38 inches.

7. A system as forth in claim 6 wherein the tip of said waterjet is approximately 0.38 inches from said workpiece and said waterjet is vertical with respect to the workpiece.

8. A system as forth in claim 1 wherein said enclosure comprises a box like structure having one open end proximate to the workpiece.

9. A system as forth in claim 8 including said video camera being located at the end of said enclosure opposite the open end and said illuminating means comprising a pair of lights mounted on opposite walls of said enclosure with said waterjet located through a wall of said enclosure between said light mounted walls.

10. A system as forth in claim 1 wherein said enclosure comprises a structure having one open end spaced by mounted to the workpiece and a second open end extending vertically from said first open end with said waterjet vertically mounted along said second open end to partially block same.

11. A system as forth in claim 10 including an angled wall opposite said second open end having said video camera and said illuminating means mounted therealong.

12. A system as forth in claim 11 wherein said angled wall is angled at approximately 45° angle to provide depth perception of the workpiece to said video camera mounted thereto.

13. A system as forth in claim 12 wherein the tip of said waterjet is approximately 0.38 inches from the workpiece and said waterjet uses a mixture of high pressure water and garnet to cut the workpiece.

14. A system as forth in claim 13 wherein said means for supplying clean water exhausts 10 gallons/minute of clean water into said enclosure.

15. A method of enhancing the visibility of an underwater waterjet cutting of a workpiece comprising the steps of:

providing a waterjet for remotely cutting a workpiece under the control of an operator viewing a video camera view of the cutting process;

enclosing the waterjet and the video camera within an enclosure placed against the workpiece to provide a peripheral opening between the enclosure and the workpiece; and supplying a stream of cold water to the enclosed waterjet and video camera to set up an annular flow of clean water past the video camera and to the waterjet to entrain and exhaust the cuttings from the workpiece directly away from the enclosure without clouding up the water therein.

16. A method as set forth in claim 15 including the step of tilting the video camera at an angle of approximately 45° with respect to the workpiece to provide depth perception of the cut.

* * * * *